US005470508A

United States Patent [19]

Narayanan et al.

[11] Patent Number: 5,470,508

[45] Date of Patent: Nov. 28, 1995

[54] AQUEOUS OIL REMOVAL COMPOSITION CONTAINING HIGHER-ALKYL PYRROLIDONE

[75] Inventors: Kolazi S. Narayanan, Palisades Park; Ratan K. Chaudhuri, Butler; Robert B. Login, Oakland; Frank Fusiak, Bayonne, all of N.J.

[73] Assignee: ISP Investments Inc., Wilmington, Del.

[21] Appl. No.: 195,128

[22] Filed: Feb. 14, 1994

Related U.S. Application Data

[63] Continuation-in-part of Ser. No. 826,328, Jan. 24, 1992, abandoned.

[51] Int. Cl.[6] ..... C11D 1/83; C11D 3/28; C23G 5/036

[52] U.S. Cl. ..... 252/542; 134/40; 252/153; 252/171; 252/DIG. 8

[58] Field of Search ..... 252/153, 170, 252/364, 542, DIG. 8, 173, 171; 134/38, 40

[56] References Cited

U.S. PATENT DOCUMENTS

| | | | |
|---|---|---|---|
| 5,035,859 | 7/1991 | Gu et al. | 252/542 |
| 5,071,463 | 12/1991 | Narayanan et al. | 71/79 |
| 5,085,795 | 2/1992 | Narayanan et al. | 252/162 |
| 5,093,031 | 3/1992 | Login et al. | 252/357 |
| 5,252,245 | 10/1993 | Garabedian, Jr. | 252/153 |

FOREIGN PATENT DOCUMENTS

| | | | |
|---|---|---|---|
| 45-28904 | 9/1970 | Japan | 252/542 |
| 782898 | 9/1957 | United Kingdom . | |

OTHER PUBLICATIONS

*Research Disclosure* Dec. 1989 Disclosure No. 308103 "Stable Pesticide Emulsions" (Disclosed Anonymously) pp. 981–982.

Sasaki et al. "Enhancing Effect of Combining Two Pyrrolidone Vehicles on Transdermal Drug Delivery" *J. Pharm. Pharmacol.* vol. 42 No. 3 Mar. 1990 pp. 196–199.

*Primary Examiner*—Linda Skaling Therkorn

*Attorney, Agent, or Firm*—Jules E. Goldberg; William J. Sapone; Joshua J. Ward

[57] ABSTRACT

A three part cleaning composition uses $C_6$–$C_{20}$ alkyl substituted lactam as a cleaning agent, an anionic surfactant and water to solubilize and remove oil or grease from hard surfaces. The lactam is provided in a ratio, relative to surfactant of 5-0.1 to 5-3.0, more preferably 5-0.1 to 5-1.0. The composition is surprisingly effective in forming microemulsions with the oil or grease and maintaining the emulsions for ease in disposal. Using an aqueous solution including $C_6$–$C_{20}$ alkyl substituted lactam provides a low volatility, non-flammable degreasing solution, which is highly effective and biodegradable.

8 Claims, 1 Drawing Sheet

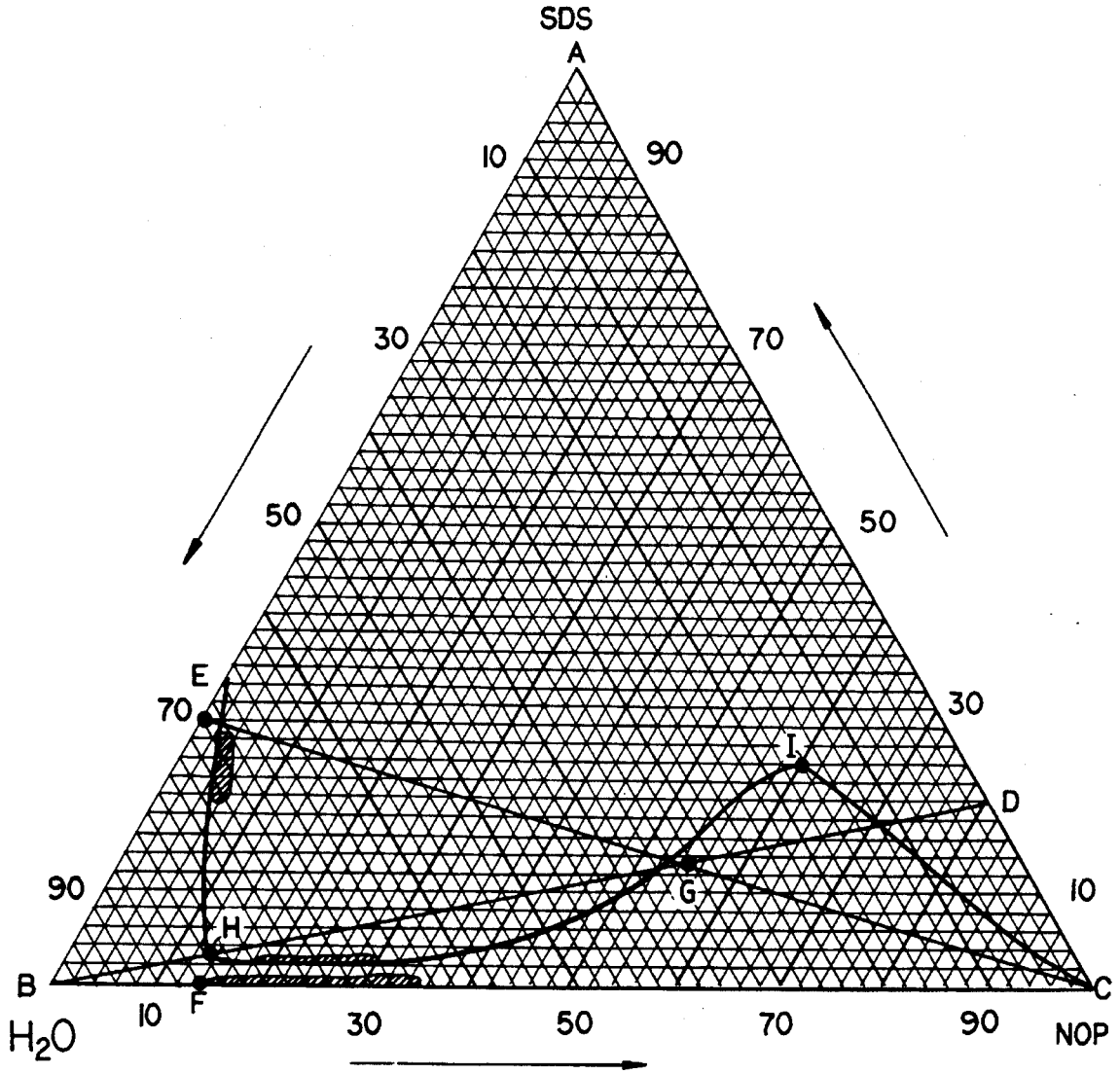
SDS
A
10
90
30
70
50
50
E
70
30
I
D
90
G
10
H
B
C
F
10
30
50
70
90
NOP
$H_2O$

AQUEOUS OIL REMOVAL COMPOSITION CONTAINING HIGHER-ALKYL PYRROLIDONE

CROSS REFERENCE TO RELATED APPLICATIONS

This application is a Continuation in Part of application Ser. No. 07/826,328 filed Jan. 24, 1992, now abandoned.

TECHNICAL FIELD

This invention relates to oil removal compositions and more particularly to an aqueous composition containing higher alkyl pyrrolidone, an anionic surfactant and water.

BACKGROUND OF THE INVENTION

N-methyl-2-pyrrolidone (NMP) is known as a solvent and cleaning agent. For example, in U.S. Pat. No. 3,673,099, N-methyl-2-pyrrolidone is combined with a strong base such as alkali hydroxide for stripping cured resins such as silicones. In U.S. Pat. No. 4,276,186, N-methyl-2-pyrrolidones is used with an alkanolamine to remove solder flux from integrated circuit chip carriers. In U.S. Pat. No. 5,011,621, N-methyl-2-pyrrolidone is used in a paint stripping composition. In U.S. Pat. No. 4,587,032, N-methyl-2-pyrrolidone is used in a drain cleaner composition. However, the higher alkyl pyrrolidones are not known for use as water-based oil removal/degreasing agents due to their poor solubility in water.

Many degreasing compositions presently used rely on chlorinated solvents or petroleum based materials for their effectiveness. However, these materials are not favored due to their volatility and potential for generating fugitive emissions. In some instances flammability is a problem. Also, successful biodegradability of an oil removal/degreasing composition has not been achieved.

SUMMARY OF THE INVENTION

It is an object of the present invention to provide an oil removal composition which is biodegradable.

It is a further object to provide an aqueous oil removal composition which is highly effective, particularly for removing oil and grease from hard surfaces.

It is a further object to provide an aqueous oil removal composition which may be prepared as a concentrate for convenient shipping and handling for later addition of water prior to use.

It is yet another object of the present invention to provide an aqueous oil removal composition which produces a micro emulsion with the oil to be removed.

It is yet another object of the present invention to provide an aqueous oil removal composition which exhibits enhanced wetting properties to increase oil removal effectiveness.

These and other objects of the present invention are achieved by an aqueous oil removal composition comprising 0.01–90% $C_6$–$C_{20}$ alkyl substituted lactam as a cleaning agent, 0.01–24% of an anionic surfactant and water, the lactam to surfactant ratio being from 5 to 0.1, to 5 to 3.0. In such a proportion, a completely homogenous oil removal composition is produced.

It has been found that in the prescribed ranges, lactams, such as $C_6$–$C_{20}$ alkyl substituted pyrrolidone, remain soluble and no phase separation occurs. Consequently, the higher alkyl pyrrolidone is uniformly distributed in the composition which makes it effective as a cleaning agent in contacting and removing grease and oil. In particular, baked-on grease from ball bearings and driveway oil stains have been removed using the inventive composition, and these are known to be particularly difficult cleaning operations. Additionally, the cleaning composition is non-flammable, biodegradable and has low volatility for reducing the possibility of generating fugitive emissions.

BRIEF DESCRIPTION OF THE DRAWINGS

The FIGURE is a three component phase diagram for N-octyl-pyrrolidone, sodium dodecyl sulfate and water.

DETAILED DESCRIPTION OF THE INVENTION

The composition of the present invention contains one or more higher alkyl substituted lactams, an anionic surfactant and water. For purposes of this disclosure, the term "higher alkyl" refers to $C_6$–$C_{20}$ alkyl.

The term "lactam" is inclusive of caprolactam and pyrollidone Similarly the term "pyrollidone", where used includes lactams. The lactams as shown in Formula I may be used in the invention.

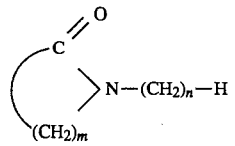

I.

Where m=3, 4, 5 and n=6–20.

Preferably, the higher-alkyl pyrrolidones of the Formula II are used.

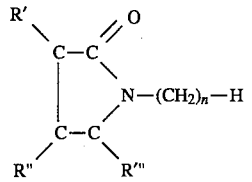

II.

Where n=6–20, R', R" and R'" are H, lower alkyl, alkoxy, cycloalkyl, or aralkyl.

Most preferred are N-octyl-pyrrolidone, N-dodecylpyrrolidone or mixtures thereof.

As the anionic surfactant, alkali metal salts of $C_8$–$C_{22}$ aliphatic sulfates or sulfonates, such as sodium dodecyl sulfate, alkali metal salts of alkyl aromatic sulfates or sulfonates, and ethoxylated versions of the above, such as the alkylphenyl ethoxylated phosphate esters, may be used. The anionic surfactants may form pseudo salts or ion pairs with the higher-alkyl pyrrolidones, and are believed to produce synergistic effects on wetting and surface spreading.

Water is the third ingredient, and the three components should be present in particular proportions. The higher alkyl lactam should be present at about 0.1–90%, preferably 10–70% by weight, most preferably 20–70% by weight. The anionic surfactant should be present at about 0.01–24%, preferably 1–20% and most preferably 2–10%, with the ratio of lactam to surfactant ratio being 5 to 0.1 to 5 to 3.0, preferably 5 to 0.1 to 5 to 1.0.

The oil removal composition may be premixed as a concentrate containing 20–70%, preferably 25–35% of the required water. Typically, the concentrate could be diluted in a 1:10 to 1:100 ratio, concentrate to water, to produce the oil removal composition of the invention. The preferred concentrate has 35–65% lactam and 5–20% anionic surfactant, using the ratios described above, balance water. Optionally, thickeners, foaming agents, defoamers, etc can be added.

Referring to the Figure, a phase diagram for the mixture of N-octyl-2-pyrrolidone, sodium dodecyl sulfate and water is shown. As is seen from the diagram, one can solubilize N-octyl-2-pyrrolidone in water at practically any concentration by the addition of the anionic surfactant. Preferably, about 2% anionic surfactant is present. Solubilized homogeneous solutions of N-octyl-pyrrolidone, sodium dodecyl sulfate and water are shown under the curve bounded by points EHIC with these solubilized compositions being particularly suitable for removing oil, grease and other such materials from hard surfaces, quickly and effectively.

Compositions falling within the shaded areas form gels which can be formulated as oil lifting compositions. Such a gel may be placed in a squeeze bottle for direct application for spot cleaning or diluted with water before use. Compositions falling outside the shaded areas may still be formulated as gels by adding gel forming agents or thickeners such as carboxyl propylcellulose or carboxyl ethylcellulose (KLUCEL H). The compositions covered by the regions bounded by points EBFH are particularly suited to forming micro emulsions with hydrophobic compounds.

EXAMPLE I 6.9 grams of sodium dodecyl sulfate (SDS), (29% aqueous solution) and 10 grams of N-octyl-2-pyrrolidone (NOP) were added to 83 grams of water. The composition had the following ingredients in weight percent; 10% NOP, 2% SDS and 88% deionized water. To 10 grams of this solution was added 0.3 grams of kerosene which immediately formed an emulsion. This mixture was diluted with an additional 60 grams of water yet the kerosene remained completely solubilized and absorbed and could not be seen by the naked eye.

COMPARATIVE EXAMPLE 2

To 60 grams of water was added 0.3 grams of kerosene. The kerosene floated on top. No emulsion or micro-emulsion formed.

COMPARATIVE EXAMPLE 3

To 56 grams of water were added 0.3 grams of kerosene and 6.8 grams of sodium dodecyl sulfate. No emulsions formed and small drops of kerosene floated on top of the water.

COMPARATIVE EXAMPLE 4

To 60 grams of water were added 10 grams of N-octyl-2-pyrrolidone and 0.3 grams of kerosene. Again, an oil phase formed on top of the water.

EXAMPLE 5

A concentrate comprising 6g N-ocyl-2-pyrrolidone and 3.5g 29% aqueous sodium dodecyl sulfate was diluted by the addition of 350g of water. To this was added 2.0 g of kerosene at room temperature (23° C.). The kerosene was completely solubilized and absorbed.

The compositions and results of examples 1–5 are shown in Table I which demonstrates that the prescribed mixture is useful for absorbing oil or grease in a biodegradable cleaning formulation.

TABLE I

| Composition % wt | Example 1 | Comparative example 2 | Comparative example 3 | Comparative example 4 | Example 5 |
|---|---|---|---|---|---|
| Kerosene | 0.48 | 0.50 | 0.48 | 0.43 | 2.91 |
| NOP | 1.61 | 0 | 0 | 14.2 | 9.71 |
| SDS | 0.32 | 0 | 3.12 | 0 | 1.94 |
| Water | 97.59 | 99.5 | 96.40 | 85.37 | 85.44 |
| Total | 100 | 100 | 100 | 100 | 100 |
| | complete instant micro emulsion | two phase | two phase | two phase | complete instant micro emulsion |

EXAMPLES 6–10

Five formulations were additionally prepared for testing to remove motor oil stains which ranged in age from 7 days to greater than 1 month from a driveway. Table II shows the five formulations which had varying amounts of N-octyl-2-pyrrolidone (NOP), sodium dodecyl sulfate (SDS), the amount and/or presence of sodium dodecyl sulfonate, and the amount and/or presence of N-dodecyl-2-pyrrolidone (NDDP).

TABLE II

| Composition Wt. % | Example 6 | Example 7 | Example 8 | Example 9 | Example 10 |
|---|---|---|---|---|---|
| NOP | 10 | 60 | 30 | 10 | 30 |
| SDS | 2 | 10 | 10 | 0 | 0 |
| LAS | 0 | 0 | 0 | 2 | 10 |
| NDDP | 0 | 0 | 20 | 0 | 20 |
| $H_2O$ | 88 | 30 | 40 | 88 | 40 |
| Total | 100 | 100 | 100 | 100 | 100 |

The compositions were poured liberally onto an oil stain and grease stain covering approximately a one square foot area and left to stand for 10–15 minutes. The spot was spray rinsed with water from a garden hose for 1–2 min. and then the water lightly swept with a coarse broom into a drain. The following results were obtained.

TABLE III

| % Removal | Example 6 | Example 7 | Example 8 | Example 9 | Example 10 |
|---|---|---|---|---|---|
| Fresh Oil stain (1–7 days old) | <5% | 100% | 80% | <5% | 90% |
| Greater than 1 month old oil stain | <5% | 20% | 15% | <5% | 15–20% |

Three of these compositions were effective in removing the oil stains from the concrete driveway. Examples 6 and 9 were not as effective in this application due to their low concentrations of active components. However, they are effective in other less severe oil removal applications.

EXAMPLE 11

3 gals of deionized water were placed in an ultrasonic tank, 1 pt. of the composition of Example 7 (60% NOP, 10%

SDS, 30% water) was added and mixed thoroughly until a clear homogenous solution developed. The ultrasonics were set at full power (240 watts, 40 KHz). A basket with ball bearings containing baked on grease was placed in the bath for five minutes. After removal and rinsing with deionized water, the bearings were rinsed with isopropanol and then cold air blown dry for ten minutes.

The ball bearings were completely cleaned of grease and oil, and a white surface smut was also removed. The performance was comparable to parts cleaned with a hydrocarbon degreaser at 150° F.

The temperature of the bath was raised to 180°–200° F. and the cleaning cycle repeated. However, the bearings were immersed in the ultrasonic bath for only 2 mins. The results were similar to the ambient temperature results. A slight phase separation was noted as the solution turned milky white. Cleaning however was excellent. Upon cooling, the solution cleared and the oil and grease rose to the surface.

COMPARATIVE EXAMPLE 12

The procedure of example 11 was used, however, only 1 pt. of 29% aqueous sodium dodecyl sulfate was added to the ultrasonic bath containing deionized water (3 gal); no higher alkyl pyrrolidone was used.

At 75°–80° F., a basket of ball bearings was immersed in the bath for 5 mins. with full ultrasonic power. The cleaning was poor as grease, carbon and white smut remained on the surface of the bearings.

The temperature was raised to 160°–180° F. After 5 mins, the bearings appeared visually clean but on inspection with 10× to 40× magnification, numerous black and white specks were apparent. The bath was also cloudy.

EXAMPLE 13

100 g of NOP were added to the bath of example 12 and, upon mixing thoroughly, the bath cleared, possibly indicating that the oil and grease micro-emulsified. The cleaning steps were repeated using the mixed bath and additional sets of ball bearings. In both instances, the ball bearings were completely clean and free of smut and carbon deposits. Under 10×40× magnification, no black or white specks were apparent.

EXAMPLE 14

Two microscope glass slides were coated with beeswax which was allowed to solidify. The slides were immersed in the mixed bath of Example 13 at a temperature of 150° F. After 1 min, the slides were completely cleaned with no visible residue.

EXAMPLE 15

To approximately 3 gallons of water was added 100 g of the composition of Example 7 with thorough mixing. Half of a barbecue grill caked up with grease and carbonized residues was placed in the bath. After immersing in the liquid for 2 hours, without any agitation, the liquid was rinsed off with water using a garden hose. The grease was completely removed from the grill. However, deposits of carbonized residues persisted. The liquid appeared uniformly discolored with no distinctive phases. The grease was effectively micro-emulsified.

EXAMPLE 16

Several 25×74 mm glass microscope slides were immersed into a jar of liquified bacon grease (70° C), removed and the excess allowed to drain off. The slides were placed in a freezer at −15° C. to facilitate solidification of the grease on the slides. The slides were removed from the freezer after 30 mins and placed in a desiccator for 1 hr. to remove condensed water from the slides. The slides were then immersed in A) water, B) water with 0.4% of a commercial dishwashing detergent (CDO) containing a semi-polar non-ionic detergent, an alkaline earth metal salt of an anionic detergent and an amino butylbotaine and C) water with 0.04% composition of Example 7. The solutions were non-agitated and maintained at 45° C. to simulate household warm water. After 15 mins., the slides were removed and excess water was allowed to drain off. The slides were placed in a desiccator overnight. The results are shown in Table IV.

TABLE IV

| Solution | Initial weight (g) | after cleaning weight (g) | % removal |
|---|---|---|---|
| A - Water | 4.5875 | 4.5771 | 10.42 |
| | 4.7325 | 4.6933 | 36.91 |
| B - Water | 4.6968 | 4.5917 | 100% |
| w/CDO | 4.8538 | 4.7401 | 100% |
| C - Water | 4.7069 | 4.6215 | 96% |
| w/NOP SDS | 4.6760 | 4.5699 | 97.8% |

Slides removed from solutions B and C appeared clean, shiny and free from grease. The cleaning baths were hazy in the following order: B<C<A. Over 95% removal is considered excellent performance.

EXAMPLES 17–19

The following examples of the cleaning composition of the invention are derived from FIG. 1.

TABLE V

| Comp. Wt. % | 17 | 18 | 19 |
|---|---|---|---|
| NOP | 50 | 40 | 10 |
| SDS | 8 | 5 | 6 |
| Water | 42 | 55 | 84 |
| Total | 100 | 100 | 100 |

Utilizing the inventive formulation, oil and grease removal from hard surfaces is achieved without using chlorinated or hydrocarbon solvents. The solution absorbs oil to prevent re-deposition prior to rinsing to effectively remove the oil. Upon biodegradation or chemical degradation, the oil is released and may be separately collected for disposal, or treated in a typical waste treatment system.

What is claimed is:

1. A concentrate of an aqueous homogeneous cleaning composition for removing oil or grease from a hard surface consisting essentially of 20–70% by weight $C_6$–$C_{20}$ alkyl substituted cyclic lactam, 5–20% anionic surfactant and 15–55% water, the lactam to surfactant ratio being 5–0.1 to 5–3.0, wherein the $C_6$–$C_{20}$ alkyl substituted lactam is selected from the following:

I.

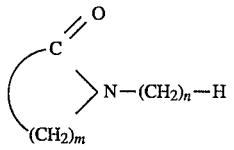

Where m=3, 4, 5 and n=6–20 or a pyrrolidone of the formula

II.

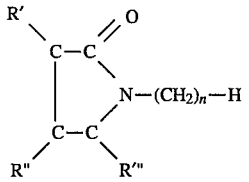

wherein n=6–20, and R', R", and R'" are H, lower alkyl, alkoxyl, cycloalkyl, or aralkyl.

2. The concentrate of claim 1 consisting essentially of 60% N-octyl-2-pyrrolidone, 10% sodium dodecyl sulfate and 30% water.

3. The cleaning composition of claim 1 wherein the $C_6$–$C_{20}$ alkyl substituted lactam is a pyrrolidone of the following formula:

II.

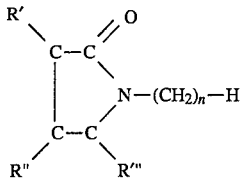

where n=6–20, R', R" and R'" are H, lower alkyl, alkoxyl cycloalkyl, or aralkyl.

4. The cleaning composition of claim 3 wherein the $C_6$–$C_{20}$ alkyl substituted pyrrolidone is from the group consisting of N-octyl-2-pyrrolidone, N-dodecyl-2-pyrrolidone, N-octadecyl-2-pyrrolodione and mixtures thereof.

5. The cleaning composition of claim 1 wherein the anionic surfactant is from the group consisting of alkali metal salts of $C_8$–$C_{22}$ aliphatic sulfates or sulfonates and alkali metal salts of alkyl aromatic sulfates or sulfonates.

6. The cleaning composition of claim 1 wherein the anionic surfactant is an alkali metal salt of a $C_8$–$C_{22}$ aliphatic surfactant.

7. The cleaning composition of claim 1 wherein the anionic surfactant is sodium dodecyl sulfate.

8. The cleaning composition of claim 1 wherein the lactam to surfactant ratio is 5–0.1 to 5–1.0.

* * * * *